US006264124B1

(12) United States Patent
Pallmann

(10) Patent No.: US 6,264,124 B1
(45) Date of Patent: Jul. 24, 2001

(54) WEARING ELEMENT FOR COMMINUTING MACHINES WITH ROTATING KNIFE HEAD

(75) Inventor: Wilhelm Pallmann, Zweibrücken (DE)

(73) Assignee: Pallman Maschinenfabrik GmbH & Co. KG, Zweibrücken (DE)

( * ) Notice: Subject to any disclaimer, the term of this patent is extended or adjusted under 35 U.S.C. 154(b) by 0 days.

(21) Appl. No.: 09/413,155

(22) Filed: Oct. 6, 1999

(30) Foreign Application Priority Data

Oct. 7, 1998 (DE) ..... 298 17 914 U

(51) Int. Cl.[7] ..... B02C 18/18
(52) U.S. Cl. ..... 241/92; 241/294; 241/300
(58) Field of Search ..... 141/176, 162.1, 141/172; 241/92, 93, 300, 294

(56) References Cited

U.S. PATENT DOCUMENTS 4,405,092 * 9/1983 Sybertz et al. ..... 241/300

FOREIGN PATENT DOCUMENTS 3505077 1/1987 (DE) .

* cited by examiner

*Primary Examiner*—Mark Rosenbaum
(74) *Attorney, Agent, or Firm*—Friedrich Kueffner

(57) ABSTRACT

Aa wearing element for a comminuting machine whose rotating knife head includes a support disc, a support ring arranged coaxially to the support disc and knife carriers which are distributed uniformly over the-circumference and are arranged axially between the support disc and the support ring. The wearing element is composed of a plate having a certain thickness and the shape of a ring sector. The plate covers the inner periphery of the outer side of the support ring and has in the area of the gap between two knife carriers an inclined surface extending over the thickness of the wearing element toward the support ring. A wearing lip for protecting the support ring is arranged so as to extend or elongate the inclined surface portion.

6 Claims, 2 Drawing Sheets

WEARING ELEMENT FOR COMMINUTING MACHINES WITH ROTATING KNIFE HEAD

BACKGROUND OF THE INVENTION

1. Field of the Invention

The present invention relates to a wearing element for a comminuting machine whose rotating knife head includes a support disc, a support ring arranged coaxially to the support disc and knife carriers which are distributed uniformly over the circumference and are arranged axially between the support disc and the support ring. The wearing element is composed of a plate having a certain thickness and the shape of a ring sector. The plate covers the inner periphery of the outer side of the support ring and has in the area of the gap between two knife carriers an inclined surface extending over the thickness of the wearing element toward the support ring. The wearing element is an element which is subject to wear during normal use.

2. Description of the Related Art

Comminuting machines of the above-described type, as they are known, for example, from DE 35 05 077 C2, are suitable, among other purposes, for comminuting long timber. The long timber to be cut is cyclically moved in the axial direction up to a stop plate in the interior of the cutting space of a comminuting machine. While the portion of the long timber extending out of the cutting space is secured, a rotating knife head moves during each work cycle transversely of the axial direction of the timber and shortens the timber over a length which corresponds to the depth of the cutting space. Subsequently, the knife head is returned into the initial position, the pieces of timber are once again moved up to the stop in the cutting space and a new work cycle begins.

In machines of this type, the knife head which defines the cutting space is composed of a support disc, a support ring arranged coaxially to the support disc and knife carriers arranged between the support disc and the support ring. The knife carriers are uniformly distributed over the circumference of the knife head, wherein an axial gap is defined as a result of a predetermined distance between the individual knife carriers. The chips are moved from the cutting space and the area of the knife head through this gap.

In order to be capable of comminuting also the portion of the timber extending into the cutting space, it is necessary that the knives held in the knife carriers extend at least up to the outer side of the carrier ring. If this were not the case, the support ring would contact the timber with its inner surface and would prevent a transverse movement of the knife head. A problem in this connection is the removal of the chips produced in the area of the support ring. In order to ensure that the chips are conducted into the interior of the comminuting machine, the inner surface of the support ring is provided in the gap area between two knife carriers over the entire width thereof with an inclined surface portion extending toward the interior of the comminuting machine. This inclined surface portion forms a duct through which the chips are conducted toward the gap between two knife carriers.

When such comminuting machines are operated, significant wear phenomena can be observed in the area of the duct which makes it necessary to prematurely exchange the support ring. This wear is due to impurities in the material to be comminuted in the form of water, sand and dirt which over time lead to crack-like erosions and impair the strength of the support ring as a result.

In order to prevent these problems, plate-shaped wearing elements have been arranged at the inner circumference of the outer side of the support ring, wherein these plate-shaped wearing elements have at the location of the duct an inclined surface portion and which over the thickness thereof protect a portion of the inner surface of the support ring. This measure has turned out not to be sufficient because wear phenomena still occur at the non-protected portion of the inner surface of the support ring and at the inner side thereof.

SUMMARY OF THE INVENTION

Therefore, it is the primary object of the present invention to provide a wearing element which essentially prevents wear of the support ring.

In accordance with the present invention, a wearing lip for protecting the support ring is arranged so as to extend or elongate the inclined surface portion.

The configuration according to the present invention provides the advantage that the wearing element covers the support ring over the entire length of the chip removing duct. The present invention intentionally disregards the possible argument that a wearing lip cannot withstand the high loads occurring during the hard operation of a comminuting machine of this type. However, as a result of the invention, the support ring is no longer subjected to a direct wear load, so that the intervals for exchanging the support ring are increased. The wearing elements, on the other hand, which are of a sufficiently wear-resistant material, can be easily exchanged because of their size and easy accessibility. Consequently, the invention reduces the costs for material as well as for personnel.

Another advantage of the invention is the special configuration of the wearing element which makes it possible to use it as a replacement part for wear plates already in use. Consequently, in existing comminuting machines, it is not necessary to exchange the entire support ring but only the wear plates.

In accordance with a special embodiment of the present invention, the wearing element is positioned on the support ring in such a way that it covers with its middle portion approximately the gap between two knife carriers. As a result, the wearing lip can be fastened at the wearing element in a statically favorable position. Sufficient space for a problem-free chip removal is provided by a recess at the edge of the wearing element, so that the wearing lip and, thus, the chip removing duct are located in a relatively low position at the wearing element.

In accordance with an advantageous feature, the cross-section of the wearing lip is trapezoidally shaped. This protects the bottom of the chip removing duct which is subjected to high loads. When wear phenomena occur at the side surfaces of the chip removing duct, it is advantageous to equip the wearing lip with a U-shaped cross-section, so that the entire chip removing duct is protected.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 2:
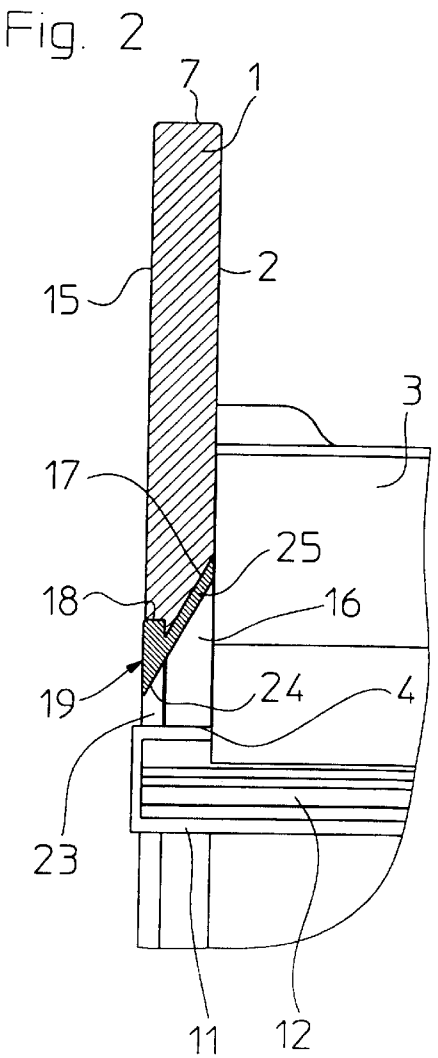
FIG. 2 is a sectional view through the support ring with knife carrier taken along sectional line II—II of FIG. 1.
Figure 1:
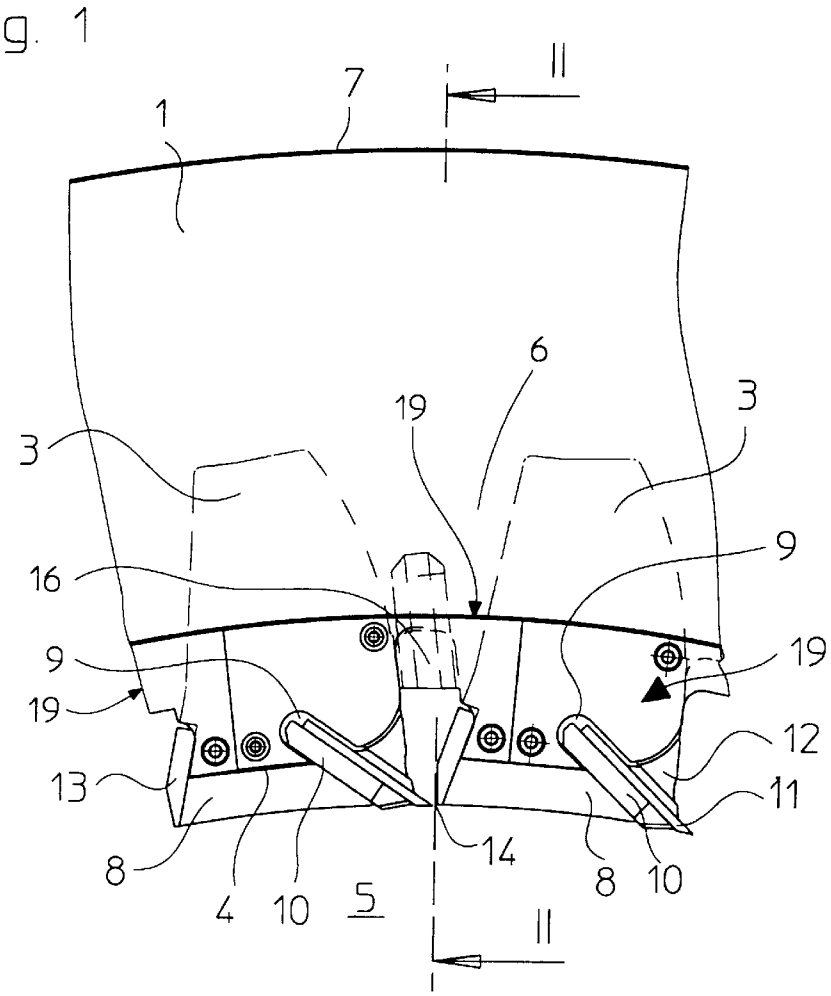
FIG. 1 is a partial view of the outer side of a support ring of a knife head of a comminuting machine.

FIGS. 1 and 2 of the drawing show a portion of a knife head in the area of the support ring 1. The support ring 1 is composed of a ring disc, wherein, on the inner side 2 of the wear ring 1 which is located opposite the support disc, not shown, of the knife head, the knife carriers 3 are arranged transversely of the plane of the disc in the area of the inner periphery 4.

The knife carriers 3 have an approximately trapezoidal cross-section, wherein the wider base of the knife carriers 3 extends beyond the inner periphery 4 of the support ring 1 and into the cutting space 5. A gap 6 of a predetermined width is maintained between the individual knife carriers 3, wherein the gap 6 widens as a result of the trapezoidal cross-section of the knife carriers 3 in the direction toward the outer periphery 7 of the support ring 1.

The base of each knife carrier 3 is covered by a wearing shoe 8 whose longitudinal side forms together with a recess 9 in the knife carrier 3 a recess for the knife holding plate 10 and the knives 11 fastened thereon. Mounted on the knives 11, in turn, is a chip breaker ledge 12.

Arranged in the lower portion of the rear side of the knife carriers 3 and at the rear side of the wear shoe 8 is a protective ledge 13 whose edge facing the cutting space 5 tapers at an acute angle and forms together with the cutting edge 11 a longitudinal gap 14 of a small width. The cut material travels through the longitudinal gap 14 into the widening gap 6 between the knife carriers 3 and further to an outlet opening in the housing bottom of the comminuting machine.

FIG. 2 shows that the knives 11 with the knife holding plate 10 and the chip breaker ledge 12 extend over the end of the knife carriers 3 and over the outer side 15 of the support ring 1. This makes it possible, simultaneously with cutting chips, to shorten the long timber by a portion of its length.

In order to conduct the chips produced in the area of the support ring 1 into the gap between two knife carriers 3, the support ring 1 has in the area of the knives 11 radial recesses 16 whose inner surfaces have toward the knife carrier 3 an inclined surface portion 17 which serves to widen the recess 16. Also shown at the outer surface 15 of the support ring 1 is a turned portion 18 which extends over a portion of the inner surface of the support ring 1 and is intended to receive the wearing elements 19 according to the present invention.

Figure 3:
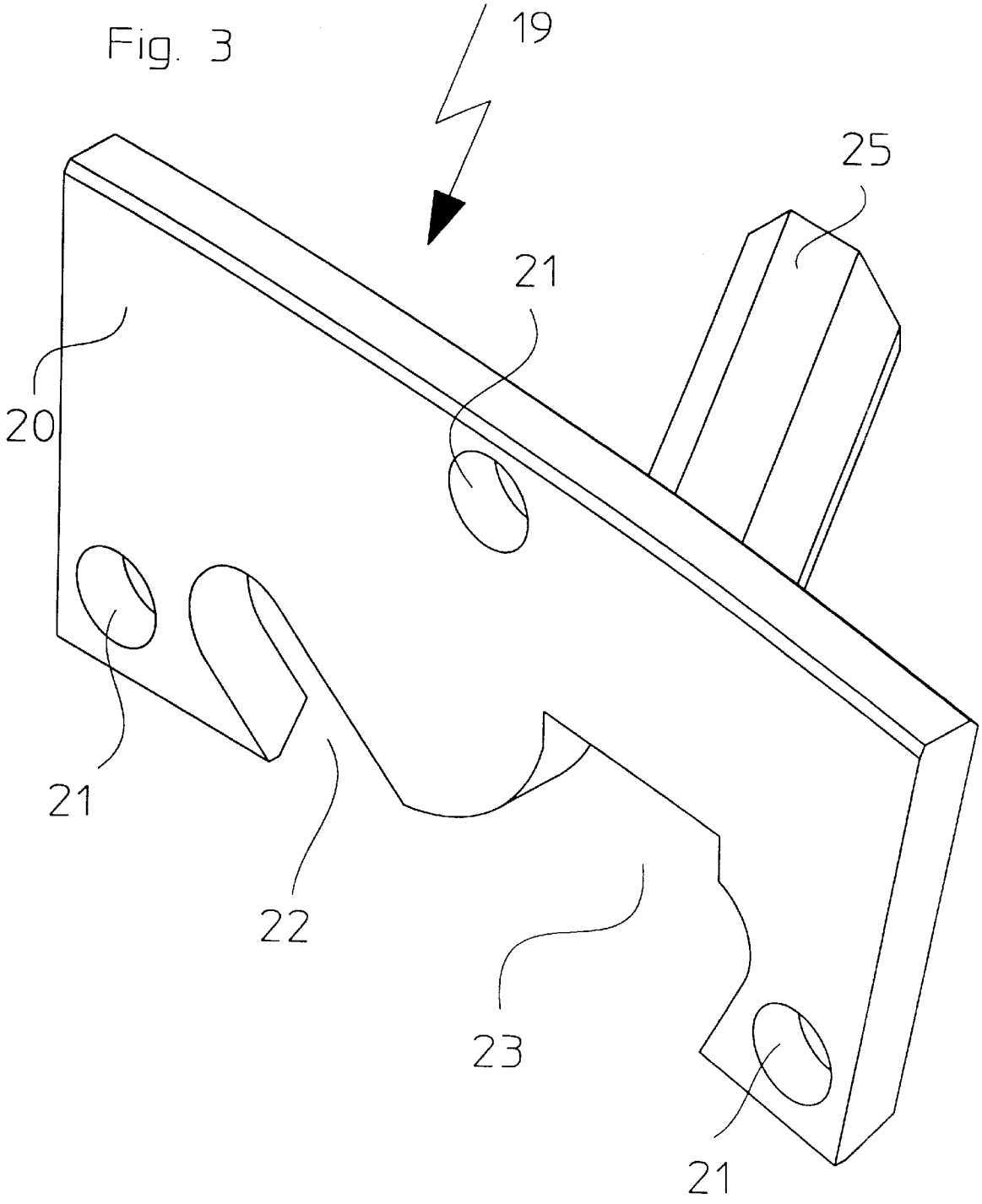
FIG. 3 is a perspective view, on a larger scale, of a wearing element according to the present invention.

As illustrated in FIG. 3, the wearing element 19 according to the present invention is composed of a plate 20 having a predetermined thickness and the shape of a ring sector. The plate 20 has bores 21 which are intended for fastening screws. The recesses 22 and 23 can be seen at the longitudinal edge of the wearing element 19 forming-the inner radius. The knife 11 as well as the knife holding plate 10 and the chip breaker ledge 12 extend through the recess 22.

The recess 23 is provided for effecting a problem-free chip removal in the interior of the comminuting machine. For this purpose, the recess 23 has corresponding to the recess 16 in the support ring 1 an inclined surface 24 which is shaped to widen the recess 23 toward the rear side. A wearing lip 25 is arranged so as to form an extension of the inclined surface portion 24 and so as to be flush with the inclined surface portion 24. The wearing lip is rigidly connected to the plate 20. The wearing lip 25 has a trapezoidal cross-section.

FIGS. 1 and 2 of the drawing show how a wearing element 19 according to the present invention is arranged within a knife head. A plurality of wearing elements 19 are arranged successively with their flat sides in their turned portion 18 of the support ring 1, so that the outer side 15 and a portion of the inner periphery 4 of the support ring 1 are covered by the wearing element 19. The wearing lip 25 is located in the inclined portion 17 of the recess 16 and protects the support ring 1 against excessive wear in this manner.

While specific embodiments of the invention have been shown and described in detail to illustrate the inventive principles, it will be understood that the invention may be embodied otherwise without departing from such principles.

I claim:

1. A wearing element in combination with a comminuting machine having a rotating knife head, the knife head comprising a support disc, a support ring arranged coaxially to the support disc and a plurality of knife carriers arranged distributed uniformly over a circumference of the knife head and axially between the support disc and the support ring, wherein the wearing element is comprised of a plate having a predetermined thickness and a shape of a ring sector, wherein the plate covers an inner periphery of an outer side of the support ring and has in an area of a gap between two knife carriers an inclined surface portion extending over the thickness of the wearing element toward the support ring, wherein the wearing element further comprises a wearing lip for protecting the support ring, wherein the wearing lip extends so as to elongate the inclined surface portion.

2. The wearing element according to claim 1, wherein the wearing element covers a gap area between two knife carriers.

3. The wearing element according to claim 1, wherein the wearing element has a recess in an area at the gap between two knife carriers.

4. The wearing element according to claim 1, wherein the wearing lip extends over an entire thickness of the support ring.

5. The wearing element according to claim 1, wherein the wearing lip has a trapezoidal cross-section.

6. The wearing element according to claim 1, wherein the wearing element has a U-shaped cross-section.

* * * * *